US010694799B1

(12) United States Patent
Gonzalez

(10) Patent No.: US 10,694,799 B1
(45) Date of Patent: Jun. 30, 2020

(54) HAIR TOWEL

(71) Applicant: The Perfect Haircare Holdings Corporation, Miami, FL (US)

(72) Inventor: Marc Antonio Gonzalez, Miami, FL (US)

(73) Assignee: THE PERFECT HAIRCARE HOLDINGS CORPORATION, Miami, FL (US)

( * ) Notice: Subject to any disclaimer, the term of this patent is extended or adjusted under 35 U.S.C. 154(b) by 65 days.

(21) Appl. No.: 15/979,167

(22) Filed: May 14, 2018

(51) Int. Cl.

| | |
|---|---|
| ***A42B 7/00*** | (2006.01) |
| ***A42B 1/04*** | (2006.01) |
| ***A45D 20/00*** | (2006.01) |

(52) U.S. Cl.
CPC ..... *A42B 1/041* (2013.01); *A42B 7/00* (2013.01); *A45D 20/00* (2013.01)

(58) Field of Classification Search
CPC .. A42B 1/041; A42B 1/12; A42B 1/04; A42B 1/045; A42B 1/00; A42B 1/06; A42B 7/00; A42B 1/043; A45D 8/40; A45D 20/00; A45D 2/46; A45D 2/00; A45D 44/08; A47K 10/02; A47K 3/127; A41D 23/00; A41D 13/1115; A41D 15/00; A41D 7/008; A41D 13/0015; A41D 2200/20; A45C 13/1046; A45C 2009/007; A45C 3/10; A45F 3/04
See application file for complete search history.

(56) References Cited

U.S. PATENT DOCUMENTS 1,577,945 A * 3/1926 Blumenthal ..... A42B 1/12 2/174
1,589,185 A * 6/1926 Lithgow ..... A45D 8/40 132/57.1
1,610,480 A * 12/1926 Seilaz ..... A45D 8/40 132/274

(Continued)

FOREIGN PATENT DOCUMENTS

| | | |
|---|---|---|
| CA | 168271 A1 | 1/1996 |
| CN | 2371930 Y | 4/2000 |
| GB | 2248391 A1 | 4/1992 |

OTHER PUBLICATIONS

"Mounted", www.yourdictionary.com/mounted; Webster's New World College Dictionary, Fifth Edition Copyright @ 2014 by Houghton Mifflin Harcourt Publishing Company. Accessed Feb. 12, 2020 (Year: 2014).*

*Primary Examiner* — Robert H Muromoto, Jr.
(74) *Attorney, Agent, or Firm* — Albert Bordas, P.A.

(57) ABSTRACT

A hair towel having a towel, and a tightening assembly with a cord assembly and a fastener. The cord assembly has an external and internal cord section, first and second ends, and a knot. The fastener has a body, an actuator, and a hole. The towel has an elongated channel to receive the cord assembly. The elongated channel has lateral ends, and defines a hole to receive the cord assembly. The elongated channel has at least one edge with stitching, whereby the stitching secures the elongated channel to the towel. The towel has exterior and interior faces, lateral edges, and first and second edges. The elongated channel is closer to the first edge than to the second edge, whereby the elongated channel is a first predetermined distance from the first edge without reaching the second edge. Furthermore, the elongated channel is approximately parallel to the first edge.

1 Claim, 5 Drawing Sheets

(56) References Cited

U.S. PATENT DOCUMENTS 1,652,933 A * 12/1927 Gaskell ..... A45D 2/46 2/195.7
1,948,556 A * 2/1934 Armsby ..... A45D 8/40 2/174
2,263,418 A * 11/1941 Ganim ..... A42B 1/041 2/204
2,568,399 A * 9/1951 Kahn ..... A42B 1/045 2/174
2,694,204 A * 11/1954 Cross ..... A42B 1/041 2/174
2,698,944 A * 1/1955 Ramsby ..... A41D 15/00 2/174
4,110,846 A * 9/1978 Hernandez ..... A41D 23/00 2/203
4,790,035 A * 12/1988 Whyte ..... A42B 1/041 2/207
5,365,613 A * 11/1994 Henegan ..... A42B 1/041 2/171
5,490,528 A * 2/1996 Day ..... A42B 1/04 132/200
5,685,016 A * 11/1997 Douglas ..... A41D 23/00 2/171
5,708,982 A * 1/1998 Armani ..... A45D 8/40 2/171
D398,420 S * 9/1998 Li Vecchi ..... D29/101.2
6,353,937 B1 * 3/2002 Martindale ..... A41D 23/00 132/200
6,427,251 B1 * 8/2002 Leach ..... A42B 1/041 2/174
6,481,020 B1 * 11/2002 Kirkland ..... A42B 1/041 2/171
6,735,783 B2 * 5/2004 Phillips ..... A42B 1/041 2/202
D506,343 S * 6/2005 Holt ..... D6/608
7,412,729 B1 * 8/2008 McGovern ..... A42B 1/041 2/174
7,437,777 B2 * 10/2008 Marquardt ..... A42B 1/043 2/202
7,500,278 B2 * 3/2009 Leach ..... A47D 5/006 5/424
7,513,001 B1 * 4/2009 Leach ..... A47C 27/086 5/632
7,708,342 B2 * 5/2010 Leach ..... A47C 7/021 297/250.1
7,793,371 B1 * 9/2010 Leach ..... A47C 20/021 5/630
8,316,466 B2 * 11/2012 Saito ..... A42B 1/041 2/202
8,468,627 B2 * 6/2013 Leach ..... A47C 20/021 5/630
8,555,429 B2 * 10/2013 Leach ..... A47K 3/127 4/572.1
8,661,587 B1 * 3/2014 Leach ..... A47D 13/08 5/630
8,910,634 B2 * 12/2014 Lu ..... A01D 13/1115 128/206.12
8,985,123 B2 * 3/2015 Green ..... A46B 9/023 132/130
D739,163 S 9/2015 Colwell
9,226,626 B2 * 1/2016 Sprague ..... A47K 10/02
9,439,492 B2 * 9/2016 Johnson ..... A42B 1/041
9,591,882 B2 * 3/2017 Duffin ..... A42B 3/0406
9,820,620 B2 11/2017 Wicker
9,907,381 B2 * 3/2018 Tussey ..... A45D 8/40
2004/0083529 A1 * 5/2004 Tate ..... A41D 13/0015 2/115
2004/0155077 A1 * 8/2004 Cullen ..... A45C 3/10 224/153
2005/0129337 A1 * 6/2005 Sabounjian ..... D06F 95/006 383/117
2009/0176049 A1 * 7/2009 Maughn-Haas ..... A47K 10/02 428/76
2015/0272294 A1 10/2015 Wicker
2016/0088979 A1 * 3/2016 Johnson ..... A45D 20/00 34/96
2019/0110542 A1 * 4/2019 Kolonne ..... A42B 1/12

* cited by examiner

HAIR TOWEL

BACKGROUND OF THE INVENTION

1. Field of the Invention

The present invention relates to towels, and more particularly, to towels for wrapping and/or drying hair.

2. Description of the Related Art

Applicant believes that one of the closest references corresponds to U.S. Pat. No. 5,365,613 issued to Kym Henegan on Nov. 22, 1994 for Hair drying towel turban. However, it differs from the present invention because Henegan teaches a hair-drying turban made from a single piece of absorbent cloth and having a cap portion and, extending forwardly, a hair basket portion. In use, the wearer places the cap portion on his or her hair with the hair extending forwardly over the forehead and face. Then, with the hair placed neatly within the hair basket portion, the hair basket is twisted about the longitudinal axis of the hair. The hair basket portion is then folded backwardly along the centerline of the cap portion and secured to the back of the cap portion. A loop is provided for allowing the turban to be easily hung on a door peg and/or, alternatively, to facilitate the tucking in of the hair basket portion beneath the cap portion.

Applicant believes that another reference corresponds to U.S. Pat. No. 5,490,528 issued to Scott A. Day on Feb. 13, 1996 for Fitted hair towel. However, it differs from the present invention because Day teaches a fitted hair towel for drying hair naturally. The fitted hair towel is adapted to fit securely on the head so that it can be worn during any activity undertaken by the wearer without restricting the range of motion. An elasticized top edge of the towel member is wrapped from the back of the head at the hairline around the sides of the head to the forehead where inverted corners are secured by fasteners. The towel member is wrapped around the hair to form a towel tube. The towel tube is twisted and wrapped over the top and against the back of the wearer's head. A strap member at the bottom edge of the towel member is pulled to draw together openings located at the bottom edge, thereby gathering the bottom edge. Opposing ends of the strap member are wrapped around either side of the wearer's head and cooperative fastening means are engaged at the wearer's forehead to secure the towel member in a wrapped configuration.

Applicant believes that another reference corresponds to U.S. Pat. No. 5,708,982 issued to Aida M. Armani on Jan. 20, 1998 for Hair towel. However, it differs from the present invention because Armani teaches a hair towel that can be first used as a cape during hair washing and treatment, and then fashioned into a bag about the head by pulling a drawstring. The towel can then be secured to the head by tying the drawstring.

Applicant believes that another reference corresponds to U.S. Pat. No. 6,427,251 B1 issued to Leach on Aug. 6, 2002 for Head towel wrap. However, it differs from the present invention because Leach teaches a towel wrap for the head of a person whose hair is wet comprising a pouch made of a towel-type fabric, the pouch consisting of a generally rectangular piece of fabric having a horizontal bottom edge approximately four feet in length, a top edge spaced above the bottom edge and including a pair of curved flaps, a pair of spaced vertical side edges connecting from the top edge to the bottom edge to form the generally rectangular piece, the flaps having peaks which are about two feet from the bottom edge and the top edge having a center portion which is about 15 inches from the bottom edge, the bottom edge having a portion about two inches wide which is folded over and stitched back on to the fabric so as to provide a two inch wide belt which extends horizontally between the two side edges, the fabric piece being folded along a vertical center line extending from the center portion of the top edge to the bottom edge, a first piece of adhesive material attached to the belt to one side of the vertical center line, an adhesive tab approximately four to six inches in length and two inches wide being sewn to an end of the belt and having a second piece of adhesive material on an under surface of the tab, the fabric piece, after being folded, being stitched along the curved flaps to connect the same together and to form the pouch, the end of the belt to which the adhesive tab is attached being on the same side of the vertical center line as the first piece of adhesive material.

Applicant believes that another reference corresponds to U.S. Patent No. D739163 S issued to Marisol Lira Colwell on Sep. 22, 2015 for Hair Drying Towel Wrap. However, it differs from the present invention because Colwell teaches a different ornamental design for a hair drying towel wrap.

Applicant believes that another reference corresponds to U.S. Pat. No. 8,316,466 B2 issued to Cynthia Saito on Nov. 27, 2012 for Secure and absorbent elongated hood. However, it differs from the present invention because Saito teaches a secure-fitting and absorbent elongated hood for containing, managing, and drying wet hair and preventing water from dripping onto flooring or onto the wearer's clothing during the hair drying or hair setting process, requiring no leaning forward of the head for application. Such elongated hood generally comprises an absorbent concave form-fitting cap having a centering button located thereon, a triangular wing of fabric extending from each of the left and right sides of form-fitting cap of elongated hood, reciprocal hook-and-loop fabric strips sewn onto each left and right triangular wing, an elongated tail region being progressively tapered from concave form-fitting cap to a rounded and concave distal end and having an elastic loop for fastening purposes, and concave petal-shaped protuberances of absorbent fabric at such concave distal end for catching, retaining, and absorbing water dripping from the wearer's hair.

Applicant believes that another reference corresponds to U.S. Pat. No. 9,439,492 B2 issued to Cherney Johnson on Sep. 13, 2016 for Wrap-n-dry towel. However, it differs from the present invention because Johnson teaches a The Wrap-n-Dry Towel that has a hook strip on one side of the towel and a loop strip on the opposite side of the towel. When the towel is wrapped around a person's head to the forehead and the hook and loop are pressed together it provides a strong wrap. The towel is never twisted into a knot and is loose on the hair and allows the hair and towel to drape down the backside of the person allowing faster drying of the hair and preventing tangling of the hair for a healthier strand of hair and ease of brushing the hair out.

Applicant believes that another reference corresponds to U.S. Pat. No. 9,820,620 B2 issued to Heidi Wicker on Nov. 21, 2017 for Towel cover. However, it differs from the present invention because Wicker teaches a towel cover for drying hair and preventing frizz. The towel cover includes a unitary sheet of fabric material having an exterior surface and an interior surface. The unitary sheet of fabric material is substantially rectangular. The opposing ends of the interior surface of the unitary sheet of fabric material may be folded to form a cavity. The cavity is configured to receive a towel. At least one fastener may be disposed along at least one edge of the interior surface of the unitary sheet of fabric material. The fastener secures the opposing ends of the interior surface to form the cavity. A towel may be positioned in the cavity between the opposing ends of the interior surface to surround an entire periphery of the towel.

Applicant believes that another reference corresponds to U.S. Patent Application Publication No. 20090176049 A1, published on Jul. 9, 2009 to Jade J. Maughn-Haas for Towel. However, it differs from the present invention because Maughn-Haas teaches a towel for use in drying hair. The towel comprises a lower-friction layer for contacting the hair. The lower-friction layer is at least partially water permeable. The towel further comprises a higher-friction layer for retaining water from the hair, which passes through the lower-friction layer. The towel may further comprise a second lower-friction layer for contacting the hair wherein the lower-friction layers are arranged either side of the higher-friction layer. The lower-friction layer(s) is (are) made of a woven material, e.g. comprising silk. The higher-friction layer is made of a wadding or sponge-like material. Drying hair with such a towel prevents damage to it.

Applicant believes that another reference corresponds to U.S. Patent Application Publication No. 20150272294 A1, published on Oct. 1, 2015 to Heidi Wicker for Towel Cover. However, it differs from the present invention because Wicker teaches a towel cover for drying hair and preventing fizz. The towel cover includes a unitary sheet of fabric material having an exterior surface and an interior surface. The unitary sheet of fabric material is substantially rectangular. The opposing ends of the interior surface of the unitary sheet of fabric material may be folded to form a cavity. The cavity is configured to receive a towel. At least one fastener may be disposed along at least one edge of the interior surface of the unitary sheet of fabric material. The fastener secures the opposing ends of the interior surface to form the cavity. A towel may be positioned in the cavity between the opposing ends of the interior surface to surround an entire periphery of the towel.

Applicant believes that another reference corresponds to U.S. Patent Application Publication No. 20160088979 A1, published on Mar. 13, 2016 to Cherney Johnson for Wrap-n-Dry Towel. However, it differs from the present invention because Johnson teaches a Wrap-n-Dry towel that has a hook strip on one side of the towel and a loop strip on the opposite side of the towel. When the towel is wrapped around a person's head to the forehead and the hook and loop are pressed together it provides a strong wrap. The towel is never twisted into a knot and is loose on the hair and allows the hair and towel to drape down the backside of the person allowing faster drying of the hair and preventing tangling of the hair for a healthier strand of hair and ease of brushing the hair out.

Applicant believes that another reference corresponds to GB Patent No. 2248391 A issued to Fiona MacTavish on Apr. 8, 1992 for Hair Towel. However, it differs from the present invention because MacTavish teaches a hair towel comprising a sheet element. The sheet element defines a first section that is profiled to fit on the head of a person for covering the person's hair. An elongate section extends from the first section and can be wound-up for tightening the first section on a person's head and then be folded back and attached to the first section for securing the location of the towel on the head of a person.

Applicant believes that another reference corresponds to CN Patent No. 2371930 Y issued to Sun Jiemei on Apr. 5, 2000 for High-efficiency water absorption hair coiling towel. However, it differs from the present invention because Jiemei teaches a towel used after bath and shampoo, which comprises a towel body. The towel body is made into a triangular towel sleeve with cambered edges by adopting flexible materials with favorable water absorption property, wherein a button and a button sleeve are respectively arranged on the front end and the rear end of the towel sleeve of which the bottom edge is provided with a contraction device.

Applicant believes that another reference corresponds to CA Patent No. 168271 A1 issued to Dale Ann Philips on Jan. 29, 1996 for Hair Towel. However, it differs from the present invention because Philips teaches a towel having a towel material that can be held to the head so that moving around freely while absorbing moisture from the hair.

Other patents describing the closest subject matter provide for a number of more or less complicated features that fail to solve the problem in an efficient and economical way. None of these patents suggest the novel features of the present invention.

SUMMARY OF THE INVENTION

The instant invention is a hair towel, comprising a towel, and a tightening assembly comprising a cord assembly and a fastener. The cord assembly comprises an external cord section and an internal cord section. The cord assembly also comprises first and second ends, and a knot. The fastener comprises a body, an actuator, and a hole. The towel comprises an elongated channel to receive the cord assembly. The elongated channel comprises lateral ends. The elongated channel defines a hole to receive the cord assembly. The elongated channel comprises at least one edge with stitching. The stitching secures the elongated channel to the towel. The towel comprises an exterior face, an interior face, lateral edges, and first and second edges. In a preferred embodiment, the elongated channel is closer to the first edge than to the second edge, whereby the elongated channel is a first predetermined distance from the first edge without reaching the second edge. Furthermore, the elongated channel is approximately parallel to the first edge.

It is therefore one of the main objects of the present invention to provide a hair towel.

It is another object of this invention to provide a hair towel for wrapping hair.

It is another object of this invention to provide a hair towel for drying hair.

It is another object of this invention to provide a hair towel, which has a tightening assembly.

It is another object of this invention to provide a hair towel, which has an elongated channel.

It is another object of this invention to provide a hair towel that is adjustable to tighten onto the head of a user.

It is another object of this invention to provide a hair towel that is adjusted to tighten onto the head of a user by a cord assembly and a fastener.

It is another object of this invention to provide a hair towel that is volumetrically efficient for carrying, transporting, and storage.

It is another object of this invention to provide a hair towel, which is durable and reliable.

It is yet another object of this invention to provide a hair towel that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
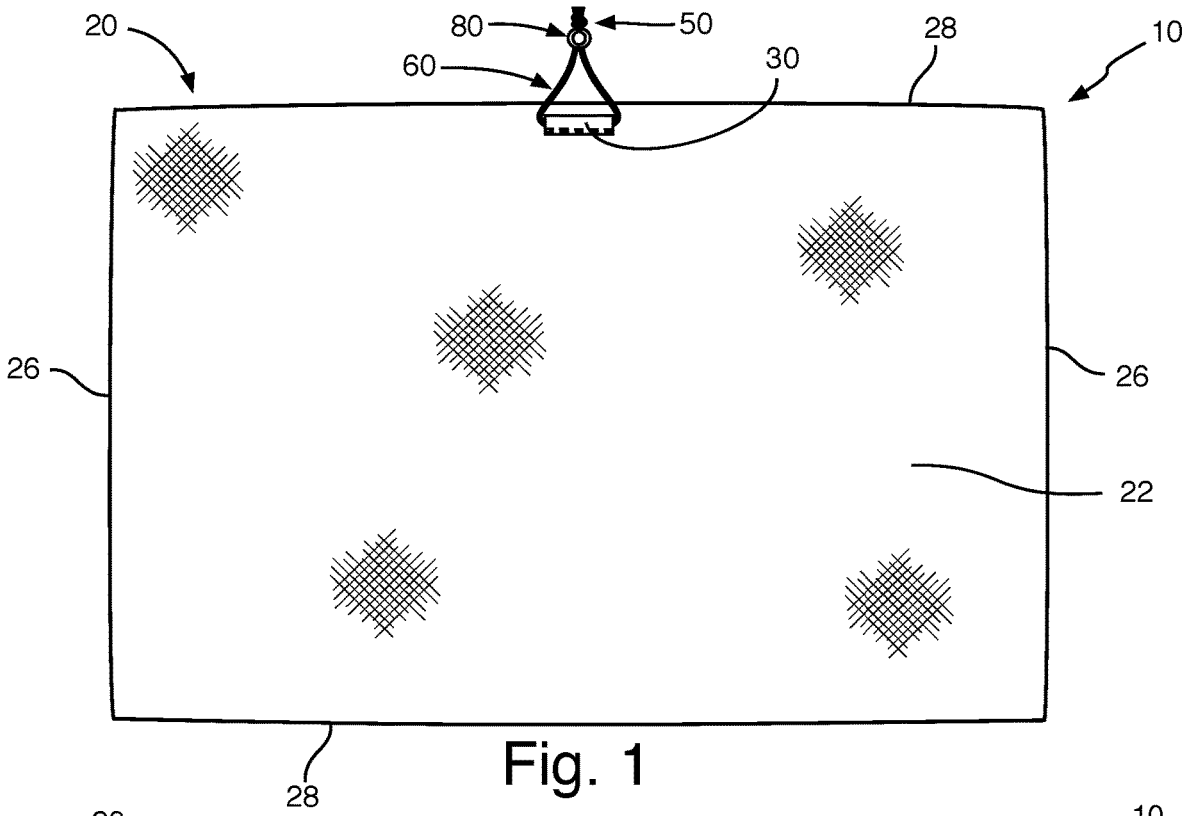
FIG. 1 is a top view of the present invention.

Referring now to the drawings, the present invention is a hair towel, and generally referred to with numeral 10. It can be observed that it basically includes towel 20 and tightening assembly 50.

Figure 2:
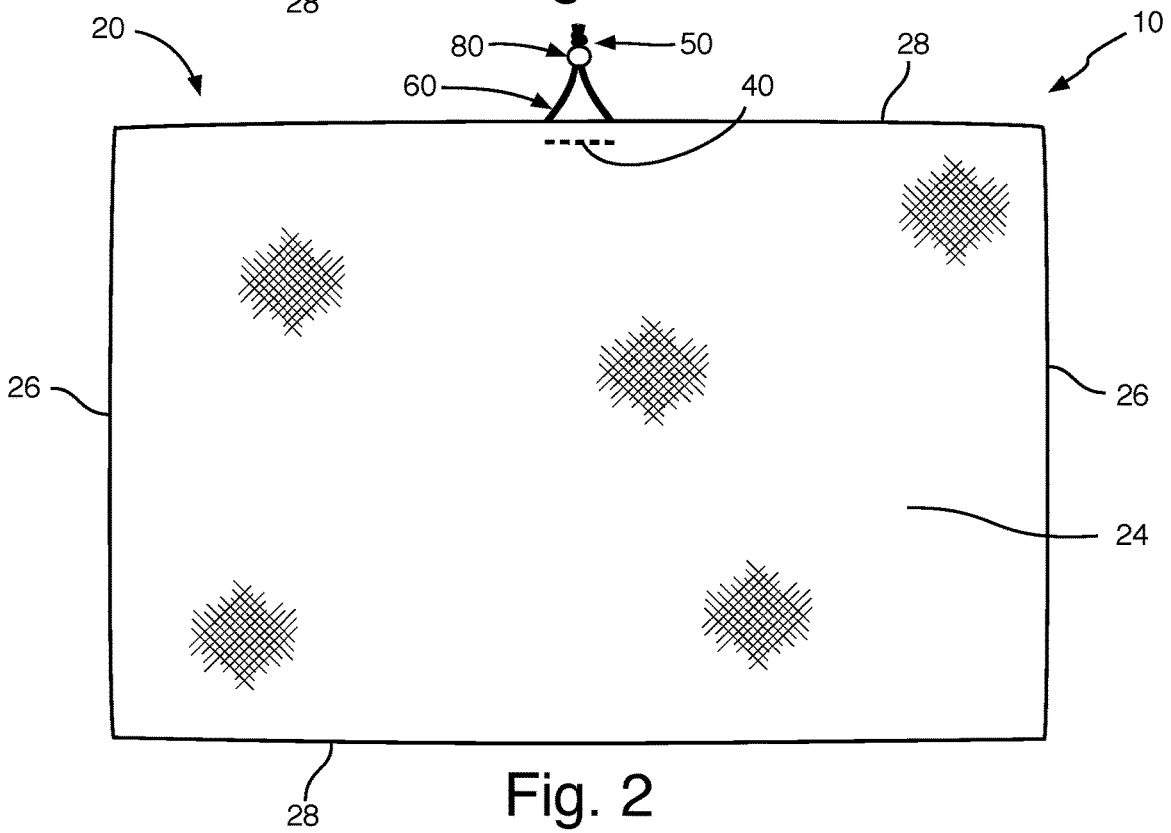
FIG. 2 is a bottom view of the present invention.

As seen in FIGS. 1 and 2, towel 20 comprises exterior face 22, interior face 24, lateral edges 26, and first and second edges 28. Exterior face 22 comprises tightening assembly 50. Tightening assembly 50 comprises elongated channel 30 to receive cord assembly 60.

In a preferred embodiment, elongated channel 30 is closer to a first edge 28 than to a second edge 28, whereby elongated channel 30 is a first predetermined distance from the first edge 28 without reaching the second edge 28. Furthermore, elongated channel 30 is approximately parallel to the first edge 28.

Figure 3A:
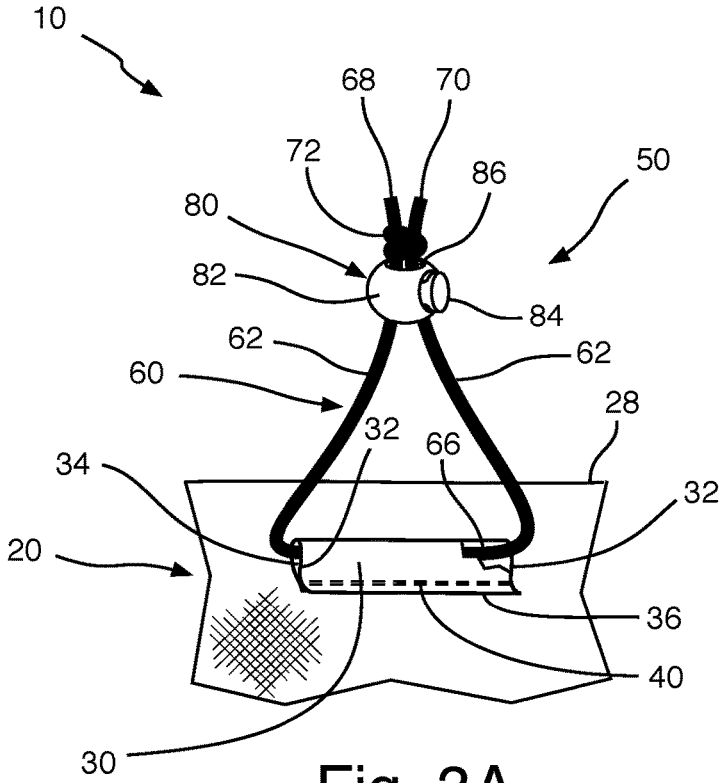
FIG. 3A is a view of a preferred embodiment elongated channel having one edge with stitching, and a cord assembly passing therethrough.
Figure 3B:
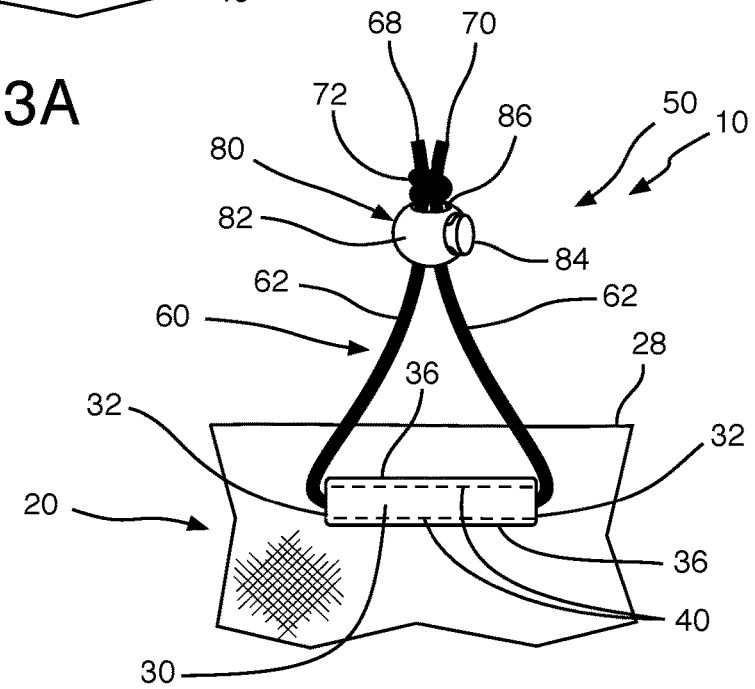
FIG. 3B is a view of an alternate embodiment elongated channel having two edges with stitching, and a cord assembly passing therethrough.

As seen in FIGS. 3A and 3B, elongated channel 30 comprises lateral ends 32. Elongated channel 30 defines hole 34 to receive cord assembly 60. Elongated channel 30 comprises at least one edge 36 with stitching 40. Stitching 40 secures elongated channel 30 to towel 20. In another embodiment, elongated channel 30 has two edges 36 with stitching 40, whereby edges 36 with stitching 40 are substantially parallel.

Tightening assembly 50 comprises cord assembly 60 and fastener 80. Cord assembly 60 comprises external cord section 62 and internal cord section 66. Cord assembly 60 also comprises first and second ends 68 and 70, and knot 72.

Fastener 80 comprises body 82, actuator 84, and hole 86. First and second ends 68 and 70 pass through hole 86 and extend therefrom.

Figure 4:
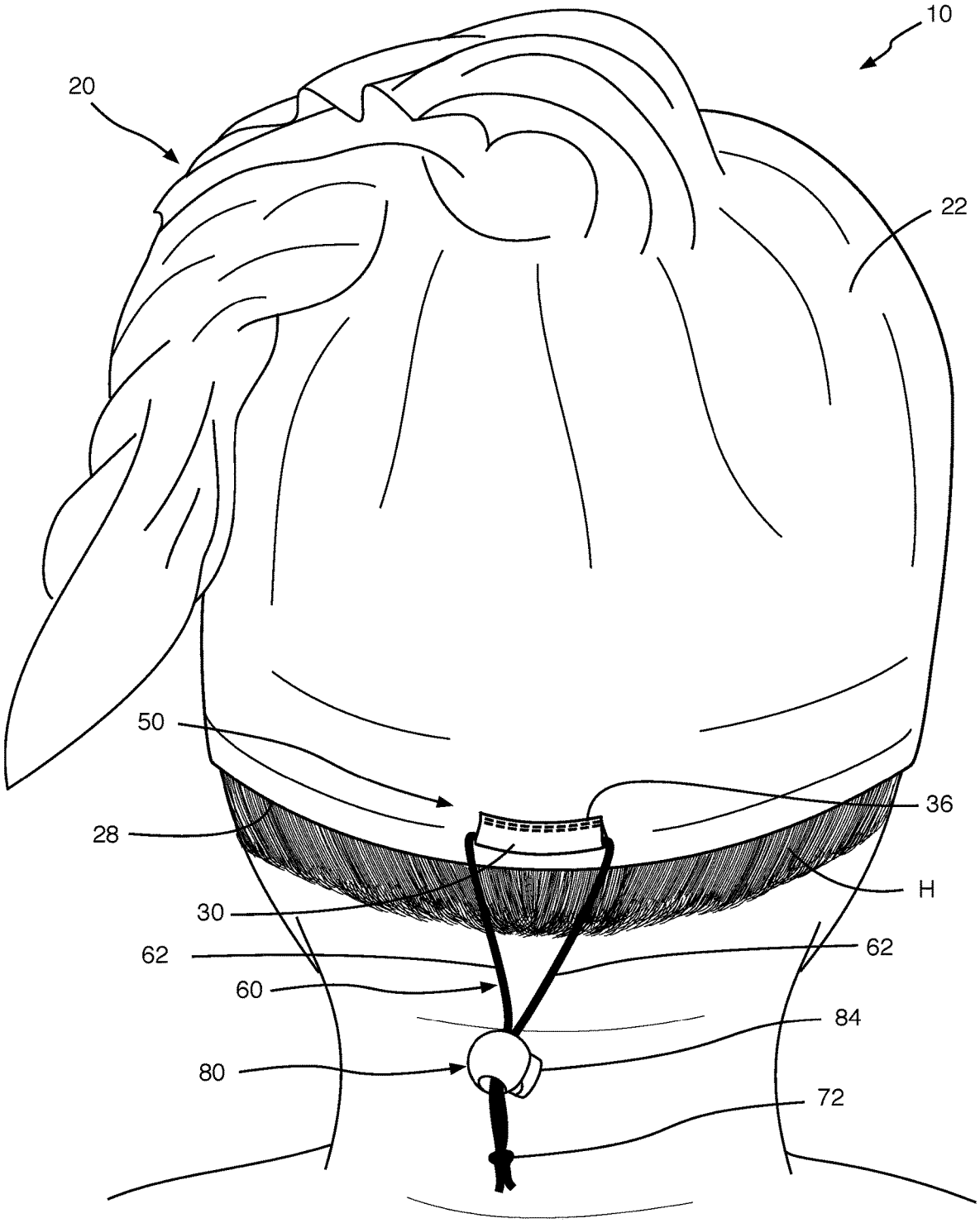
FIG. 4 is an isometric view of the present invention presented onto the head of a user.

As seen in FIG. 4, in a first use configuration, towel 20 is presented and wrapped onto the head of a user, whereby exterior face 22 faces outwardly/upwardly, and tightening assembly 50 is positioned approximately at the hairline at the back of the head of the user. It is noted that tightening assembly 50 may be positioned approximately at, above, or below said hairline.

Although not illustrated, in another use configuration, towel 20 is presented and wrapped onto the head of a user, whereby exterior face 22 faces outwardly/upwardly, and tightening assembly 50 is positioned approximately at the hairline above the face of the user. It is noted that tightening assembly 50 may be positioned approximately at, above, or below said hairline.

It is understood that present invention 10 may be secured onto the head of a user in any number of ways, all in an effort to wrap the user's hair after it is wet and to naturally dry it therein.

Figure 5:
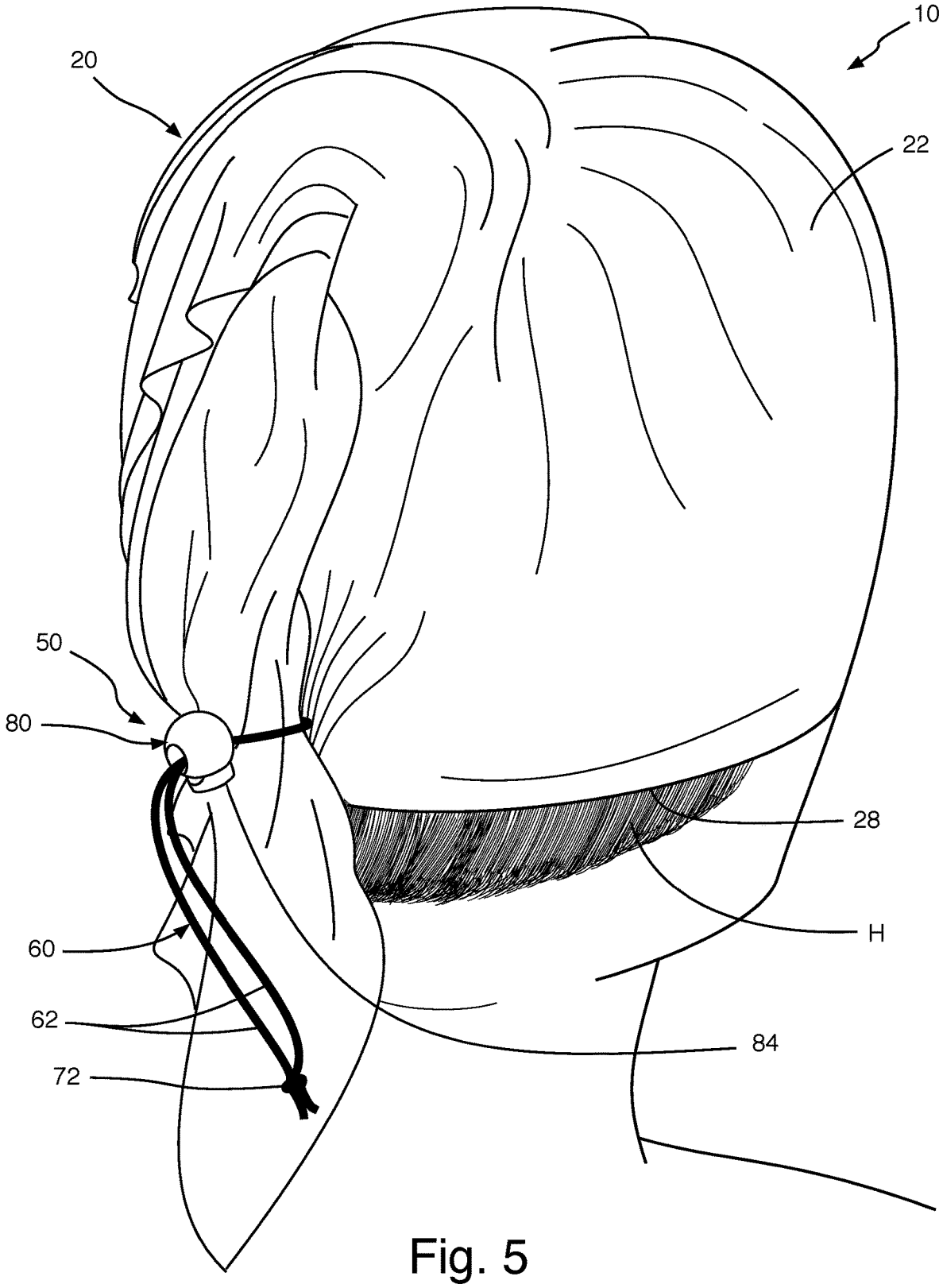
FIG. 5 is an isometric view of the present invention secured onto the head of a user in a first configuration.

As seen in FIG. 5, after towel 20 is presented and wrapped onto the head of a user as seen in FIG. 4, a remaining section of towel 20 is twisted and wrapped over the top and against the back of the user's head. The twisted section of towel 20 is then inserted into an area defined between elongated channel 30 and external cord sections 62. While pressing actuator 84, fastener 80 is positioned towards elongated channel 30 to tighten presented invention 10 onto the head of the user. Actuator 84 is then released to trap the twisted section of towel 20 between elongated channel 30 and external cord sections 62. Present invention 10 therefore securely remains on the user's head until actuator 84 is pressed to release the twisted section of towel 20 between elongated channel 30 and external cord sections 62.

Although not illustrated, it is understood that fastener 80 comprises a spring assembly that cooperates with actuator 84, whereby the spring assembly biases actuator 84 outwardly from fastener 80 in a relaxed state while trapping the section of cord assembly 60 therein.

Figure 6:
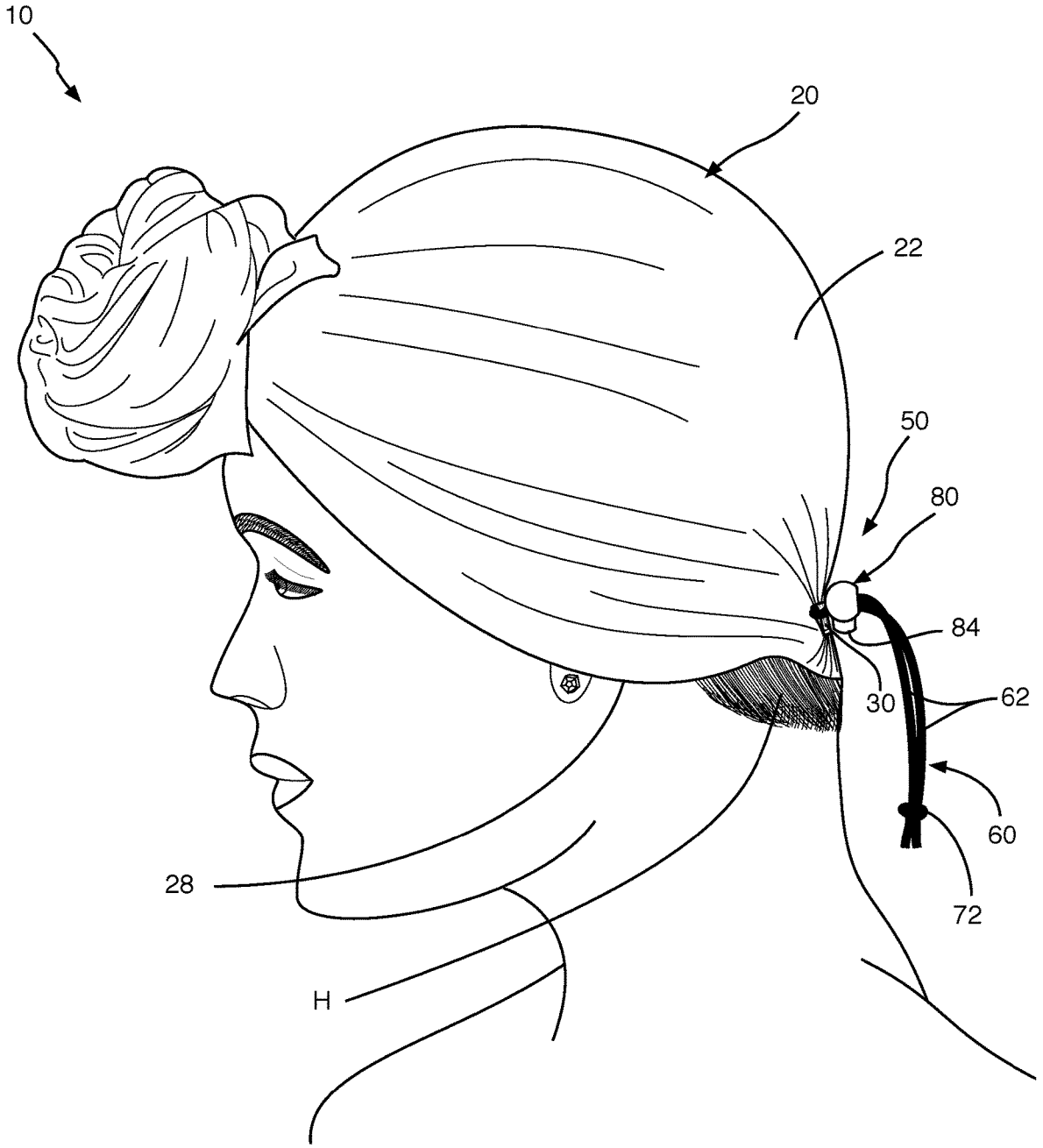
FIG. 6 is an isometric view of the present invention secured onto the head of a user in a second configuration.

As seen in FIG. 6, after towel 20 is presented and wrapped onto the head of a user as seen in FIG. 4, actuator 84 is pressed and fastener 80 is positioned towards elongated channel 30 to tighten presented invention 10 onto the head of the user. Actuator 84 is then released. Present invention 10 therefore securely remains on the user's head until actuator 84 is pressed to release cord assembly 60. A remaining section of towel 20 is twisted into a bun configuration as illustrated to accommodate hair on a front side of the head as an example allowing curls to form and dry.

In a preferred embodiment, towel 20 is made of an absorbent cloth, such as but not limited to a towel cloth or microfiber that slightly stretches. Towel 20 allows drying of hair without damage.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hair towel, comprising:

A) a towel comprising an exterior face an interior face, lateral edges, and first and second edges; and B) a tightening assembly comprising an elongated channel, a cord assembly and a fastener, said tightening assembly is cylindrical in shape and is sewn onto said exterior face, said elongated channel defines a first hole and said elongated channel receives said cord assembly through said first hole, said elongated channel comprises at least one edge with stitching, said stitching secures said elongated channel to said towel and said elongated channel comprises lateral ends, said cord assembly comprising an external cord section, an internal cord section and first and second ends, said fastener comprising a body, an actuator and a second hole, said cord assembly comprises a knot positioned over said elongated channel, and said elongated channel is closer to said first edge than to said second edge, whereby said elongated channel is a first predetermined distance from said first edge without reaching said second edge and said elongated channel is approximately parallel to said first edge.

* * * * *